US006854914B2

(12) United States Patent
Keating et al.

(10) Patent No.: US 6,854,914 B2
(45) Date of Patent: Feb. 15, 2005

(54) FLOW-THROUGH BRUSH LIQUID APPLICATOR AND METHOD OF MAKING IT

(75) Inventors: Richard J. Keating, Mahwah, NJ (US); Harley H. Mattheis, Verona, NJ (US); Jerald R. Melcher, deceased, late of Omaha, NE (US); by Helen Marie Melcher, legal representative, Omaha, NE (US)

(73) Assignee: Team Technologies, Inc., Morristown, TN (US)

( * ) Notice: Subject to any disclaimer, the term of this patent is extended or adjusted under 35 U.S.C. 154(b) by 0 days.

(21) Appl. No.: 10/132,943

(22) Filed: Apr. 26, 2002

(65) Prior Publication Data

US 2002/0176734 A1 Nov. 28, 2002

Related U.S. Application Data

(63) Continuation-in-part of application No. 09/018,512, filed on Feb. 4, 1998, now abandoned, which is a division of application No. 08/685,879, filed on Jul. 24, 1996, now Pat. No. 5,716,104, which is a division of application No. 08/209,547, filed on Mar. 10, 1994, now abandoned, which is a continuation-in-part of application No. 07/924,722, filed on Aug. 3, 1992, now Pat. No. 5,294,207.

(51) Int. Cl.[7] ..... A45B 11/04; B05C 1/00; B43K 27/04

(52) U.S. Cl. ..... 401/270; 401/17; 401/35

(58) Field of Search ..... 401/18, 24, 34, 401/35, 17, 270, 205, 206, 202, 269, 272, 273, 278, 279; 15/207.2; 300/5–8

(56) References Cited

U.S. PATENT DOCUMENTS

| | | | | | |
|---|---|---|---|---|---|
| 1,085,839 | A | * | 2/1914 | Acton | 401/279 |
| 1,878,027 | A | * | 9/1932 | Tremolda | 401/175 |
| 2,164,895 | A | * | 7/1939 | Botts | 401/273 |
| 3,400,997 | A | * | 9/1968 | Schwartzman | 401/186 |
| 3,592,202 | A | * | 7/1971 | Jones | 132/313 |
| D260,406 | S | | 8/1981 | Itoh | |
| 4,626,120 | A | | 12/1986 | Fukui et al. | |
| 4,795,063 | A | | 1/1989 | Sekiguchi et al. | |
| 4,844,299 | A | | 7/1989 | Sekiguchi et al. | |
| 4,867,593 | A | | 9/1989 | Kurokawa et al. | |
| 4,913,175 | A | * | 4/1990 | Yokosuka et al. | 132/317 |
| 4,946,302 | A | * | 8/1990 | Uchida | 401/288 |
| 5,092,702 | A | | 3/1992 | Kurokawa | |
| D329,253 | S | | 9/1992 | Sekiguchi | |
| 5,491,865 | A | * | 2/1996 | Gueret | 15/159.1 |
| 5,868,287 | A | | 2/1999 | Kurokawa et al. | |

* cited by examiner

*Primary Examiner*—David J. Walczak
(74) *Attorney, Agent, or Firm*—Luedeka, Neely & Graham, PC

(57) ABSTRACT

To form an applicator, at least one container having an open bottom and a closed tubular portion is molded and the at least one tubular portion has a corresponding one of a tubular mandril containing an applicator component inserted into it for permitting the application of fluidic material from its tip. The mandril is removed while leaving the applicator component in position within the tubular portion of the applicator container. To utilize the applicator after filling it with its ingredients, the end of the tube is broken free. A plurality of containers are connected one to the other on a base having an open end with elongated tubular members extending from each of the plurality of containers sealed at its end. A dense bristle is used having Nylon bristles with a diameter of 2 mils.

11 Claims, 13 Drawing Sheets

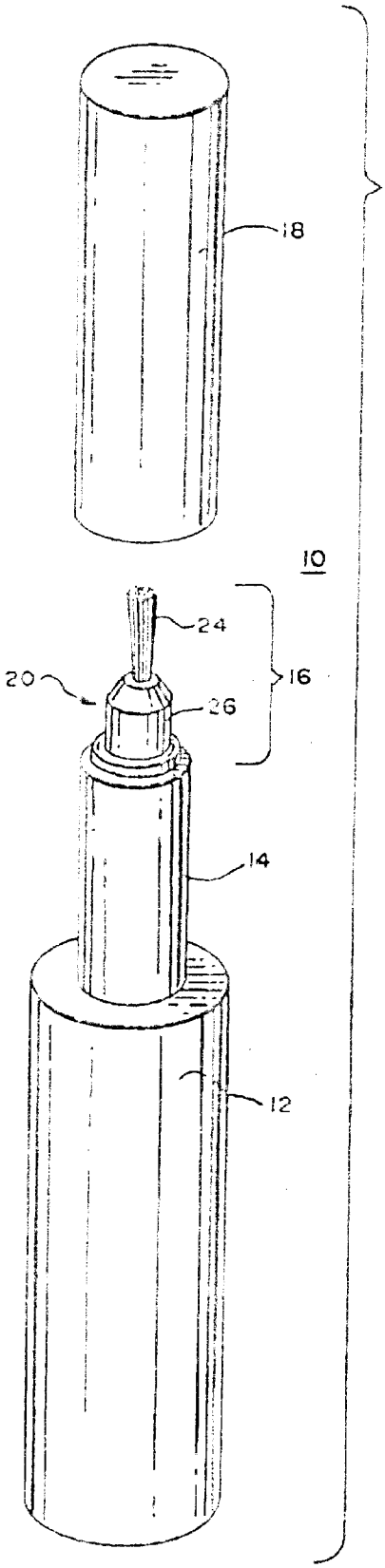
FIG. 1
FIG. 2
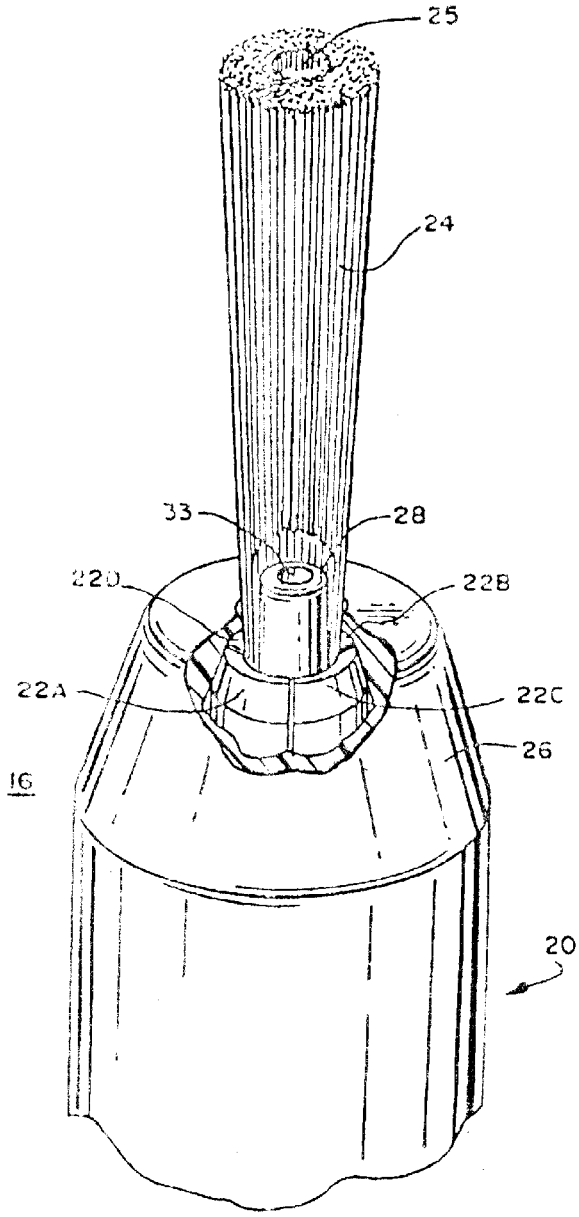

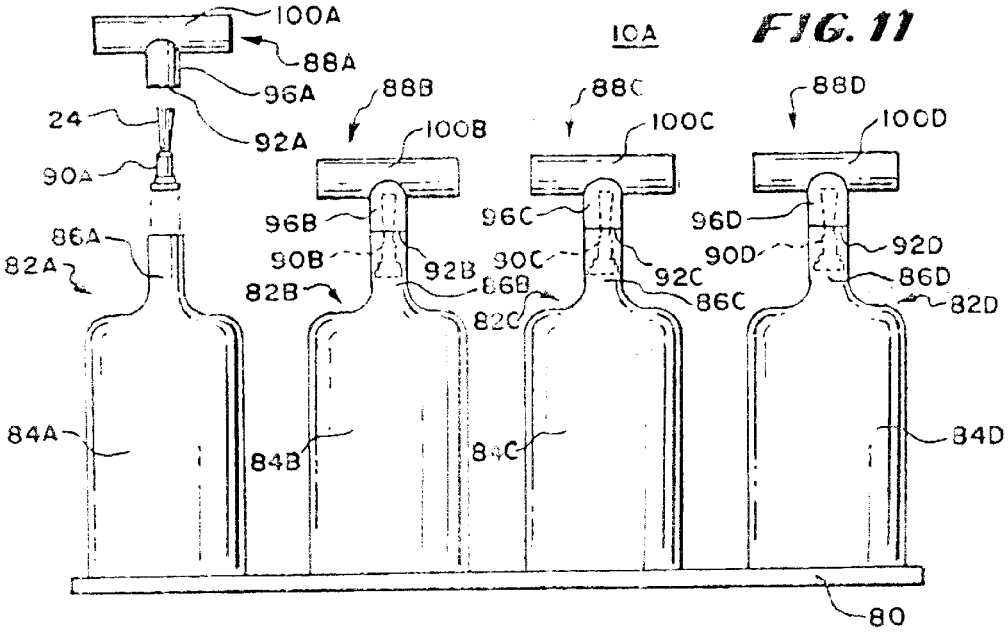
FIG. 11
FIG. 12
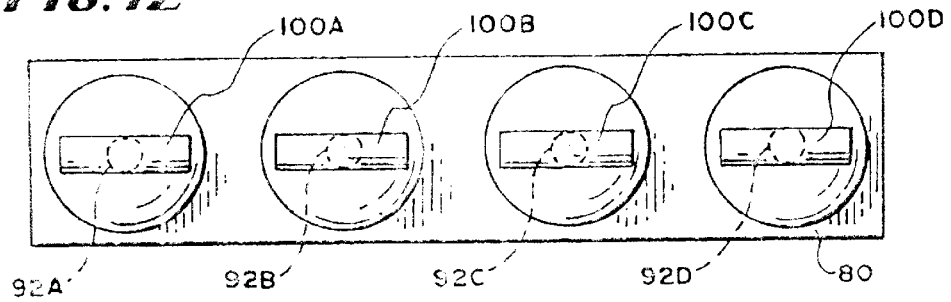
FIG. 13
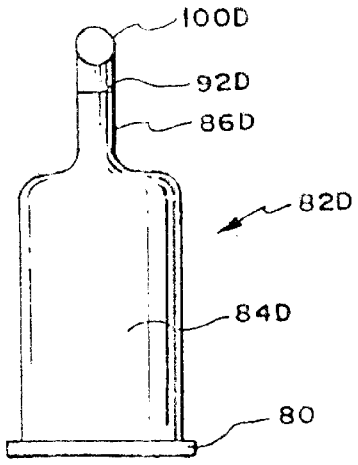

FLOW-THROUGH BRUSH LIQUID APPLICATOR AND METHOD OF MAKING IT

RELATED APPLICATIONS

This application is a continuation-in-part of U.S. patent application Ser. No. 09/018,512 filed Feb. 4, 1998, now abandoned, which is a division of U.S. patent application Ser. No. 08/685,879, filed Jul. 24, 1996, now U.S. Pat. No. 5,716,104, which is a division of U.S. patent application Ser. No. 08/209,547, filed Mar. 10, 1994, now abandoned, which is a continuation-in-part of U.S. patent application Ser. No. 07/924,722 filed Aug. 3, 1992, now U.S. Pat. No. 5,294,207 issued Mar. 15, 1994, for FLOW THROUGH BRUSH LIQUID APPLICATOR by Richard J. Keating, Harley H. Mattheis and Jerald R. Melcher.

BACKGROUND OF THE INVENTION

This invention relates to liquid applicators of the type in which bristles are used to spread the liquid, such as for example fingernail polish applicators.

In one class of brush liquid applicator, referred to as flow-through brush liquid applicators, the liquid flows through the bristles of a brush that may be used to spread the liquid. In this type of liquid applicator, the outlet from a container for the liquid is partly closed by the bristles of a small brush but there is sufficient space provided so that liquid may flow from the container and wet the bristles of the brush as the liquid is applied to a surface by the brush. A prior art type of applicator of this class utilizes a staple through the bristles to fasten them into the outlet of the container. This prior art flow-through applicator has the disadvantage of being relatively expensive to prepare and not entirely suitable for automated mass production.

It is also known to sell relatively small bottled quantities of substances such as automobile paint for covering scratches and the like. Also, breakable containers are known such as those that would be used for small quantities of medication. Small bottles with integrally-assembled applicators such as bottles of finger nail polish with a brush on the ends have been sold and are prior art.

Some of the low volume prior art containers with applicators have a disadvantage in that the liquid in them tends to dry and become clogged before they can be used. This is particularly true where a sufficient quantity is provided for repeated use but the user only sporadically uses the liquid over periods of time such as the case with an automobile owner touching up scratches on an automobile or a user of correction fluid to correct typographical errors in typing or the like. While disposable small quantity containers have been used for medication, this usage has not been extended since it has been conceived of as a control on the amount of medication that a patient could take. Such containers do not contain an applicator since the contents are intended to be swallowed.

Some applicators such as those for correction fluid have a dome shaped tip including openings through which the fluid flows. Prior art applicators of this type have a disadvantage in that the openings tend to become blocked with dried fluid.

SUMMARY OF THE INVENTION

Accordingly, it is an object of the invention to provide a novel brush type liquid applicator.

It is a further object of the invention to provide a novel flow-through applicator.

It is a still further object of the invention to provide a novel method of fabricating a flow-through applicator.

It is a still further object of the invention to provide a novel method of manufacturing a flow-through brush applicator in which the liquid being applied from a container flows through a central opening surrounded by bristles.

It is a still further object of the invention to provide a novel flow-through brush holder that is easily assembled to an applicator.

It is a still further object of the invention to provide a novel disposable low volume applicator.

It is a still further object of the invention to provide a novel method of manufacturing a low volume applicator.

It is a still further object of the invention to provide a novel method of providing applicators that resist drying and clogging.

It is a still further object of the invention to provide a novel nail polish applicator.

It is a still further object of the invention to provide a novel applicator for the application of wood stain or furniture finishing or automobile finishing.

It is a still further object of the invention to provide a novel sample container that permits the easy application of a plurality of different samples for evaluation.

It is a still further object of the invention to provide a novel fluid applicator for applying viscous quick drying liquids with minimum clogging of the applicator tip.

It is a still further object of the invention to provide a novel fluid applicator in which a valve prevents fluid from reaching the nib when not in use applying fluid to a surface.

It is a still further object of the invention to provide a novel method of making an applicator tip to provide a curved dome less susceptible to becoming clogged with drying material.

It is a still further object of the invention to provide a brush novel applicator with dense filaments of thin diameter but sufficient stiffness to be self standing resulting in an ability to apply fluid more evenly than conventional thicker filaments with lower density.

In accordance with the above and further objects of the invention, a flow-through brush applicator is: (1) formed to have a central opening; and (2) inserted into a brush holder having an opening, with the opening of the brush holder extending part-way into the central opening of the bristles. One end of the bristles are within an annular groove circumscribing the opening in the brush holder.

To hold the bristles in place, a plurality of clamp means surrounds the annular groove, which is formed in an inner shell of the brush holder. These clamp means are adapted to hold the bristles in place upon final assembly of the brush holder. Final assembly of the brush holder is accomplished by pressing an outer brush holder shell over the inner shell in which the groove is located, with the tip of the inner shell having the outlet opening and the ends of the bristles extending from the outer shell.

The brush holder of this invention may be fixed in place at the outlet of a liquid applicator such as for example a nail polish brush applicator. In this arrangement, the nail polish applicator includes at its outlet the outer and inner shells holding the bristles and forming a bristle-lined tubular-cylindrical outlet. The interior of the inner shell communicates with the interior of the container at one end and with its outlet at the other end through a circle of bristles.

To avoid the nib of the applicator from becoming clogged with dried fluid, a valve seals the nib when the applicator is not in use. In one embodiment, a passage is provided for vapors to enter the cap to maintain the fluid in solution and reduce drying. In other embodiments, the cap closes a valve between the fluid container and the tip when put on the applicator to prevent more fluid from entering the tip and opens the valve when removed and in another embodiment, a valve between the tip and the fluid container is open only when pressure is put on the nib. The clamp members may be arcuate wall sections of a truncated tubular cone that are separated from each other but may be pressed inwardly in a direction that tends to form a continuous wall of the tip of a tubular truncated cone circumscribing a narrow cylindrical tubular nose of the inner shell. When pressed together, the clamp means compress one end of the bristles to hold them at the one end against a narrow cylindrical tubular nose of the inner shell, the distal end of the nose being open to permit liquid from the container to flow out of the nose and onto the bristles which surround it. The clamp members are sufficiently flexible to bend inwardly until they are touching or nearly touching each other.

For some purposes, such as for example the application of correction fluid, it is desirable to have a rounded tip to the bristles. To form such a tip, a sickle shaped cutter is used. The sickle-shaped cutter is rotated around the point of the bristles to cut them into a dome shape. A relatively dense brush of bristles is formed of Nylon bristles having a diameter of between 2 to 5 mils and preferably 2 mils (0.002 mils inches) but being self standing and able to provide smooth application of fluid. This filament is available from DuPont de Nemours E. I. Co. Inc. having an office in Wilmington, Del., 19898, under the DuPont de Nemours E. I. Co. Inc. trademark, Tynex.

A multi-unit container-applicator includes a plurality of individual units, connected together, with each individual unit including one dose or only a few doses and a corresponding applicator. This embodiment of the invention is suitable for one application or for only a few doses to be applied within a short time period so that the applicators does not dry between applications. In this embodiment, each unit is sealed and just before use a portion of the container is broken off to expose the application.

From the above description, it can be understood that the applicators and methods of fabricating the applicators of this invention have several advantages, such as for example: (1) they enable easy assembly of the bristles to a brush holder and to a container; (2) they are relatively inexpensive, efficient applicators that permit the flow of liquid through the center of the bristles of a brush; and (3) they enable the application of fluids with minimum clogging from dried fluid.

SUMMARY OF THE DRAWINGS

The above-noted and other features of the invention will be better understood from the following detailed description when considered with reference to the accompanying drawings, in which:

FIG. 1 is a perspective view of a novel flow-through brush applicator and it corresponding container in accordance with an embodiment of the invention;

FIG. 2 is an enlarged, fragmentary, partly broken-away view of the novel flow-through brush applicator used in the embodiment of FIG. 1;

FIG. 11 is an elevational view of an embodiment of applicator assembly in accordance with the invention;

FIG. 12 is a top view of the embodiment of FIG. 11;

FIG. 13 is a side view of the embodiment of FIG. 11;

DETAILED DESCRIPTION

Figure 3:
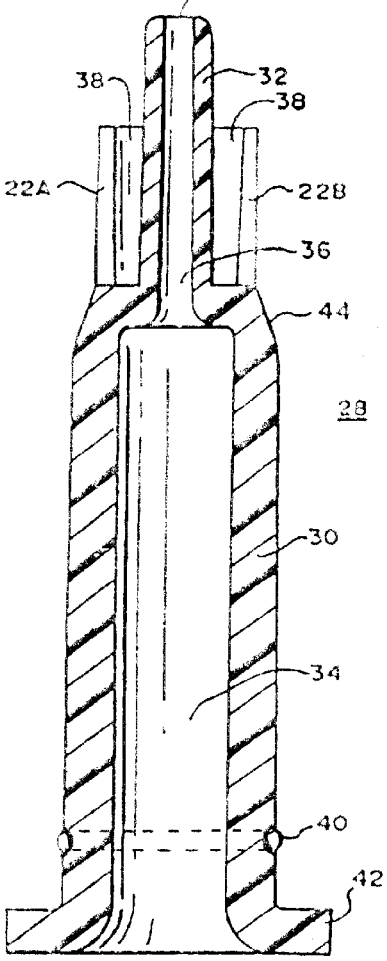
FIG. 3 is a longitudinal sectional view of a portion of the brush holder of FIGS. 1 and 2.

In FIG. 1, there is shown a flow-through applicator 10 having a container body 12, a neck 14 for the container 10, a container tip 16 and an applicator cap 18. In the embodiment of FIG. 1, the neck 14 is narrower than the container body 12 and contains threads adapted to engage threads in the cap 18 to provide a protective cover over the flow-through applicator 10. The tip 16 extends from the neck portion 14 and contains the brush of the flow through applicator 10 so that, when the container is inverted, fluid flows through the brush for application to a surface, such as for example to fingernails. The cap 18, when closed, encloses the brush at the tip 16.

The tip 16 includes a flow-through brush holder 20 having extending from it a flow-through brush 24. The brush holder 20 includes four clamp members 22A–22D (FIG. 2) that hold the brush bristles in place so that they extend from an outer shell 26 of the tip 16. The tip 16 is easily assembled to the neck portion 14 of the container 12 and is easily fabricated to hold the flow-through brush 24 in place for application of a liquid through the bristles of the brush.

In FIG. 2, there is shown an enlarged fragmentary view, partly broken away, of the tip 16 showing a portion of the flow-through brush 24 with an opening in the center indicated at 25 and extending from the outer tip of an inner shell 28 to which the bristles of the brush are clamped by clamp members 22A–22D (22A and 22C being shown in FIG. 2). The clamp members 22A–22D are moved in place by the outer shell 26, the top portion of which is shown at 26 in FIG. 2. As best shown in this view, the bristles of the brush 24 surround the outlet 33 of the container so that fluid flowing from the outlet wets the brush 24 as the liquid is applied.

In FIG. 3, there is shown a longitudinal sectional view of the inner shell 28 having an inner shell body 30, an inner shell nose 32, a plurality of clamp members 22A–22D (22A and 22B being shown in FIG. 3), an inner shell passageway 34, an inner shell nose passageway 36 and a cylindrical-tubular outlet opening 38. These parts are arranged to permit the fluid to flow from the inside of the container such as a container 12 (FIG. 1) through the inner shell body passageway 34 and inner shell nose passageway 36 into the center of the brushes 24 (FIG. 1 and FIG. 2). In the preferred embodiment, the inner shell body 30, inner shell nose 32 and clamps 22A–22D (22A and 22B being shown in FIG. 3) are integrally formed of a plastic material but of course can be made in many different ways.

The inner shell body 30 is generally tubular and cylindrical: (1) enclosing the inner shell passageway 34 which extends through it along its longitudinal axis; (2) having at its lower end a flange 42; (3) having an annular groove 40 in its outer surface, spaced a short distance from the flange 42 toward an outlet 33 and serving as one locking member; and (4) having an inwardly conical surface at 44 leading to the clamp members 22A–22D which surround the extending inner shell nose 32.

The inner shell nose 32 includes an elongated tubular wall of narrower diameter than the inner shell body 30 surrounding the inner shell nose passageway 36 which joins the inner shell body passageway 34 at one end and extends to the outlet 33 at its other end, with the outlet 33 extending into the tubular opening in the center 25 of the brush 24 (FIG. 2). The outer circumferential wall of the inner shell nose 32 forms an inner part of the clamp means for the bristles of the flow-through brush 24.

The clamp members 22A–22D, two members of which are shown at 22A and 22B, are arcuate, being shaped as segments of a truncated cone separated from each other and surrounding the cylindrical tubular outlet opening 38 which circumscribes the nose portion 32. The outlet opening 38 receives one end of the flow-through brush 24 (FIGS. 1 and 2). The clamp members 22A–22D press against the brush 24 and form the outer part of the clamp members so that the brush 24 is held between the outer surface of the inner shell nose 32 and the inner surface of the clamp members 22A–22D which, when bent inwardly in a manner to be described hereinafter, form an outer ring to hold the brush 24 in place.

In the preferred embodiment, the inner diameter of the inner shell passageway 34 is approximately 0.118 inch, the cylindrical wall is 0.050 inch thick, the diameter from the outer ends of the circular flange 42 is 0.318 inch, the length of the inner shell body 30 is 0.2 inch, the inner diameter of the inner shell nose passageway 36 is 0.028 inch and its wall diameter is 0.066 inch. The conical surface 44 is at an angle of 20 degrees to the longitudinal axis of the inner shell 28, the outer diameter of the annular groove 40 is 0.125 inch and its inner diameter (outer diameter of the inner shell nose) is 0.066 inch and the entire length of the inner shell 28 is 0.930 inch.

Figure 4:
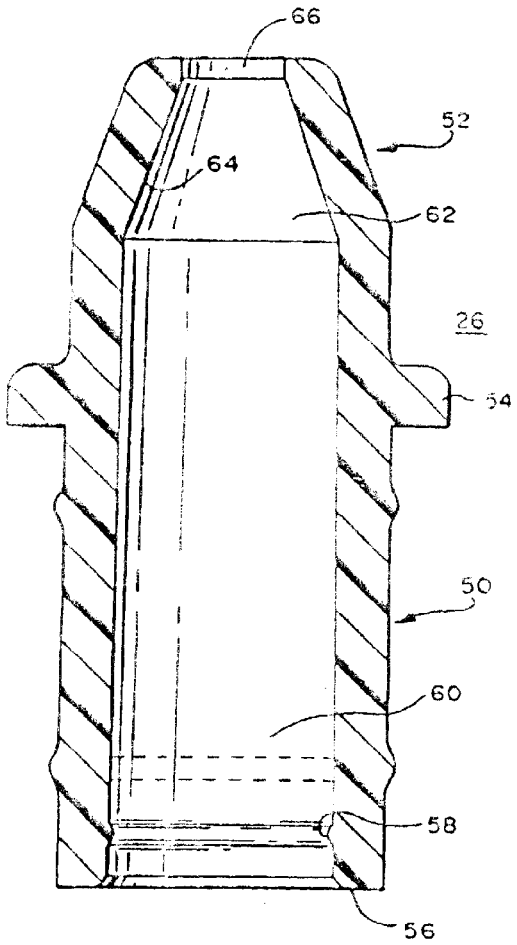
FIG. 4 is a longitudinal sectional view of another portion of the brush holder of FIGS. 1 and 2.

In FIG. 4, there is shown a longitudinal sectional view of the outer shell 26 having a tubular generally cylindrical portion 50 and a tubular frustum of a right regular cone section 52 integrally formed with each other to receive the body portion of the inner shell 28 (FIG. 3) within a passageway 60 of the right regular cylindrical portion 50 and the inner shell nose portion 32 (FIG. 3) within an inner passageway 62 of the tubular right regular frustum of a cone section 52 so that the inner shell nose 32 (FIG. 3) fits through an opening 66 in the outer shell 26.

The tubular right-regular-cylindrical portion 50 includes an annular stop surface 56, an annular boss 58 internal to the passageway 60 and an outwardly extending flange 54. The outer shell 26 is adapted to receive the inner shell 28 with the top of the flange 42 (FIG. 3) of the inner shell 28 resting upon the stop surface 56 of the outer shell 26, the annular groove 40 (FIG. 3) of the inner shell 28 receiving the annular boss 58 of the outer shell 26 to hold it in place and the conical surface 44 (FIG. 3) resting against an inner conical surface 64 of the frustum of the cone 52.

With this arrangement, the outer shell 26 can be forced over the inner shell 28 and locked in place to force the clamp members 22A–22D (FIG. 3) inwardly to hold the brush 24 in place. In the preferred embodiment, the inner diameter of the inner passageway 60 is 0.210 inch, the boss 58 and groove 40 (FIG. 3) which match have a radius of 0.01 inch, the outer opening 66 through which the nose 32 passes in the frustum of a cone section 52 has an inner diameter of 0.1 inch, the inner conical surface 64 is at an angle of 20 degrees with the longitudinal axis of the outer shell 26, the length to the flange 54 from the stopping surface 56 is 0.460 inch and the total length is 0.820 inch with a wall thickness of approximately 0.045 inch.

While two locking members including the boss 58 in the outer shell 26 and the groove 40 in the inner shell 28 (FIG. 3) are provided, any other snap mechanism could be used, and the groove 40 and the boss 58 could be reversed as between the inner and outer shell with the boss being on the outer surface of the inner shell and the groove being in the inner surface of the outer shell if desired. Similarly, many other configurations could be utilized such as square shell members or the like to provide clamping around the outlet to easily fasten the flow-through brush 24 in place.

Figure 5:
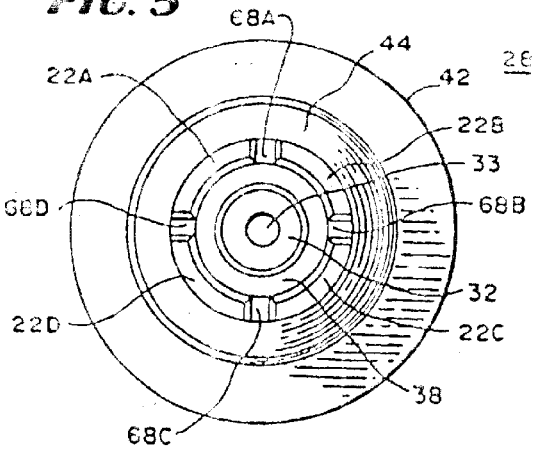
FIG. 5 is a plan view of the brush holder portion shown in the longitudinal sectional view of FIG. 3.

In FIG. 5, there is shown a plan view of the inner shell 28 showing the bottom flange 42, the conical section 44, the four clamp members 22A–22D, the tubular outlet opening 38 into which the bristles of the brush are inserted, the inner shell nose 32 and the outlet 33. As shown in this view, there are openings 68A–68D between the curved clamped members 22A–22D which permit these members to be bent radially inwardly toward the outlet 33 until they approximately touch each other and force themselves against the bristles of the brush 24 (FIGS. 1 and 2).

Figure 6:
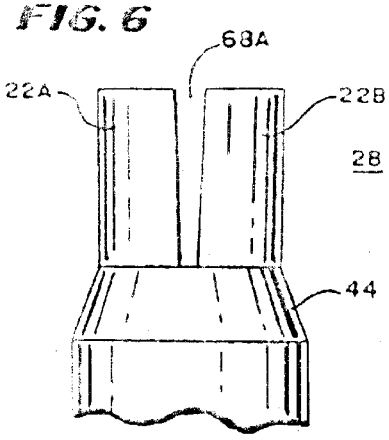
FIG. 6 is an enlarged fragmentary view of a portion of the brush holder inner shell that is a portion of the embodiment of the brush holder of FIGS. 3 and 5.

In FIG. 6, there are shown two of the clamp members 22A and 22B separated by the opening 68A and extending from the conical portion 44 illustrating the manner in which the space between them slopes so that they may be bent inwardly until they approximately touch.

Figure 7:
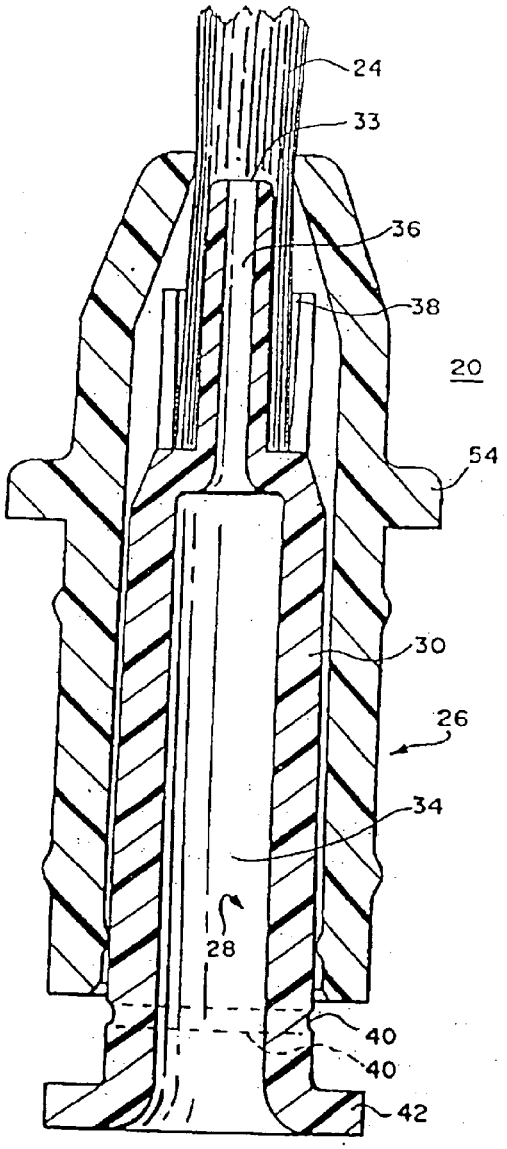
FIG. 7 is a sectional view showing one stage in the assembly of the inner member of FIG. 3 to the outer member of FIG. 4 to prepare a brush holder as shown in FIG. 1.

In FIG. 7, there is shown a longitudinal sectional view 20 of the inner shell member 28, the outer shell member 26, and the brush fibers 24 in one position during the assembly of the brush tip 16 (FIG. 1). In this position, the outer shell 26 has already been positioned above the inner shell 28 and the brush 24, with the brush 24 having been inserted in the tubular outlet opening 38 so that the top of the brush 24 fits within the wide bottom end of the outer shell 26 and is forced inwardly through the opening at the top of the outer shell 26 by the conical portions at the top of the outer shell 26.

Figure 8:
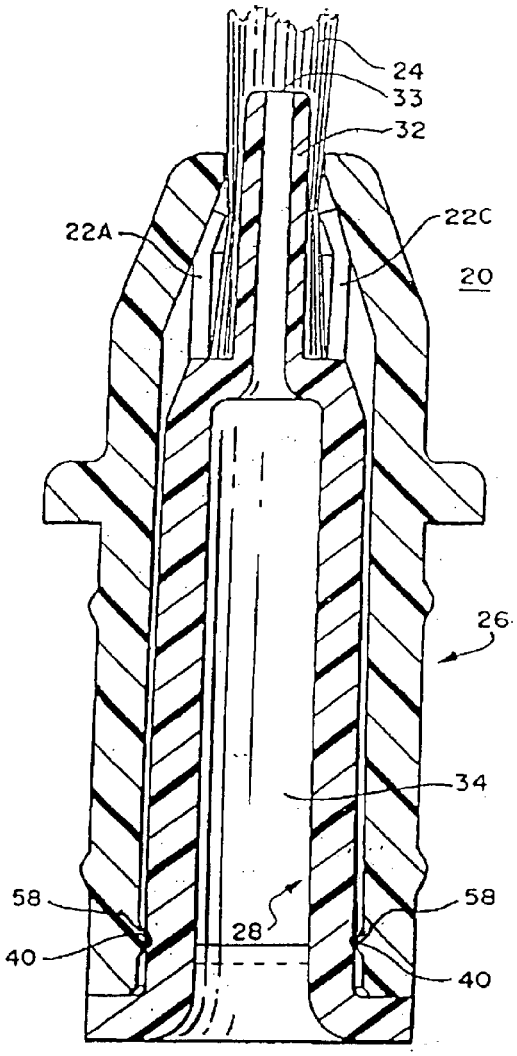
FIG. 8 is a sectional view showing another stage in the assembly of the inner and outer shell of FIGS. 6 and 7 in the fabrication of the brush holder of FIG. 1.

In FIG. 8, there is shown a longitudinal sectional view of the inner shell 28, the outer shell 26 and the flow-through brush 24 with the inner shell 28 and outer shell 26 fully engaged so that the stop surfaces mesh with each other and the groove 40 and boss detents 58 are engaged. In this position, the inner shell nose 32 extends out of the inner shell body passageway 34 and the clamp members 22A–22D (22A and 22C being shown in FIG. 8) are forced inwardly where they squeeze the brushes 24 against the nose 32 to hold them in place while permitting the outlet 33 to provide a flow path between the fluid in the applicator and the bristles of the brush 24.

Figure 9:
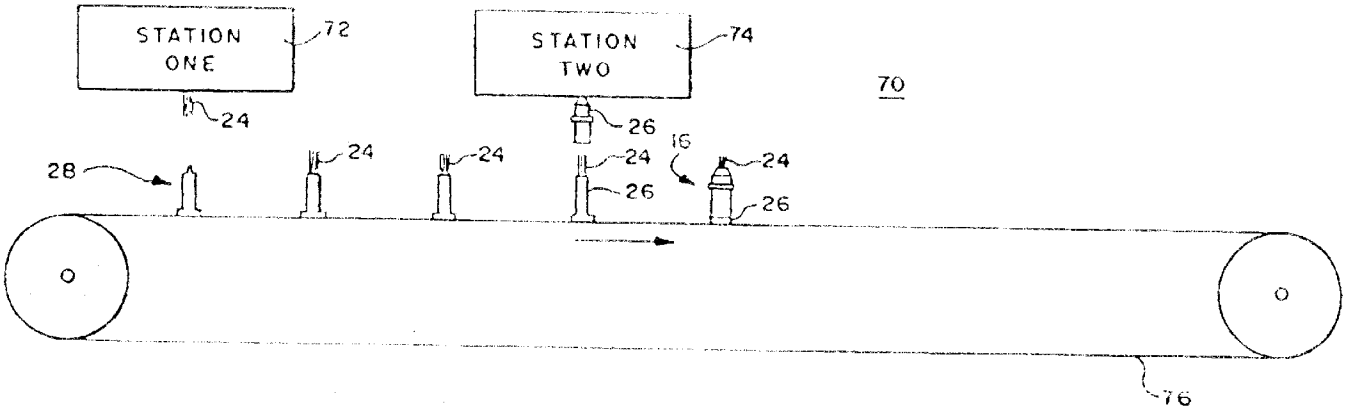
FIG. 9 is a schematic view of one series of steps performed in assembling the brush holder of FIG. 1.

In FIG. 9, there is shown a schematic drawing of an assembly system 70 having a conveyor belt 76 carrying in its top run a plurality of units to be fully assembled in a first station 72 and a second station 74. The inner shell 28 has the preformed brush 24 with a flow-through center automatically inserted into the tubular outlet opening 38 (FIG. 3) over the nose 32 (FIG. 3) at station 72 and then it is moved to station 74 in which the outer shell 26 is inserted to form a firm holder for the brush 24. The tips 16 are then removed from the conveyor system (FIG. 9) at the end to be attached to the full container at its neck 14 (FIG. 1).

Figure 10:
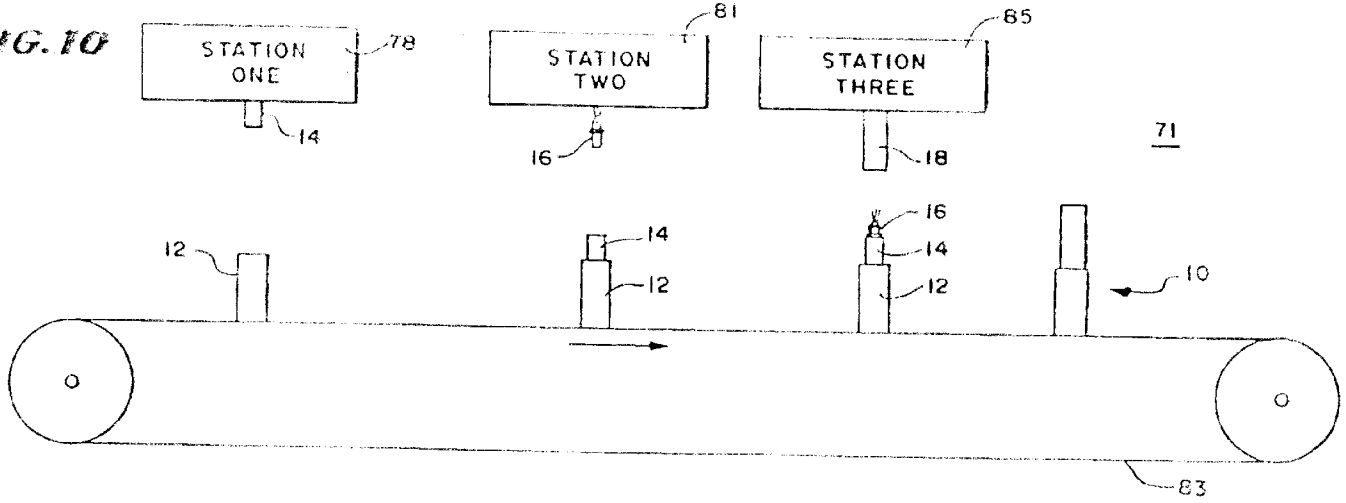
FIG. 10 is a schematic view of another portion of the assembly apparatus for assembling the brush holder of FIG. 1.

In FIG. 10, there is shown a schematic view of an assembly system 71 for assembling the tip 16 to containers which containers include a body portion 12 and a neck 14. As shown in this view, the body portion 12 is carried on a conveyor 83 and filled with a fluid at a first station 78 and the neck 14 (shown held above the body portion 12) is inserted into the body portion 12. At a second station 81, the tip 16 is inserted over the neck 14 and heat-sealed in place or sealed by any other suitable means. The caps 18 are inserted at a third station 85. It is then removed from the conveyor 83 as a full flow-through brush container 10.

In FIG. 11, there is shown an elevational view of a multi-container applicator 10A having a connecting base 80 and plurality of low volume containers, four such low volume containers 82A, 82B, 82C, and 82D respectively being shown by example, mounted to the base 80. The base 80 is a thin flat member, typically of a plastic material that is the same as that of the low volume containers 82A–82D, shown in FIG. 11 with their bottom ends sealed and connected to the base 80 to form sealed containers capable of supporting vacuum pressure if desired.

The containers 82A–82D, each include a main container portion 84A–84D respectively and a corresponding one of the container necks 86A–86D. The main container portions 84A–84D have flat bottoms attached to and projecting away from the base 80 and the corresponding narrow portions have at their top ends corresponding ones of the removable top portions 88A–88D, nozzle portions 90A–90D and breakaway lines or portions 92A–92D. The breakaway lines or portions 92A–92D separate corresponding ones of the top portions 88A–88D from corresponding ones of the nozzle portions 90A–90D so that the nozzle portions remain with the container portions 84A–84D after the top portions are removed. The nozzle portions 90A–90D are tubular and intended to include the applicator component. The top portions 88A–88D are intended to be broken away and may be immediately disposed of. It breaks open the applicator to expose one of the containers so that the applicator component may be exposed to air or rubbed against a surface. The breakaway lines or portions 92A–92D may be thinned plastic portions to control the breaking away at the correct point or may be weakened chemically or by including a removable fiber or the like.

While four containers of a specific design are shown in FIG. 11 mounted to a thin base 80, the base 80 may be of any shape and there may be any number of containers mounted to it depending upon the intended purpose of the applicator. Moreover, the connecting member may be connected to the top portions rather than to the bottoms of the main container portions. For example, in the case of medication, there may be only one applicator intended for a limited number of applications in a short period of time or perhaps only one application before the container is disposed of. In the case of fingernail polish, there may be a plurality of containers each of which may apply fingernail polish of a distinct color to ten or twenty fingernails depending on the number of applications. Other containers may be included with different colors so that a person may buy or receive the applicator and may, in a relatively short time, try out a number of different colors, depending on the number of small containers mounted to the same base. In the case of medication, a plurality of containers with dates on them may be included to aid in timing the application of a surface medication with an applicator. Also, different substances may be included in different containers, such as for example, perfume or deodorant in some containers and fingernail polish in others.

In the case of touch-up paint, a single applicator may be sold at low cost but may include touch-up paint for a number of different wood furniture finishes or for metal and wood furnishings or the like. Indeed, in the case of automobiles, a shade may be included in a separate container for each color of automobile within a certain range to economically sell packaged units to users without having an infinite number of packages.

The containers may be made of any suitable material but because of cost, generally a suitable plastic material, compatible with the fluid will be selected. The compatibility of materials with different fluids is well known in the art and the plastic may be chosen in accordance with this knowledge and may be chosen in accordance with the fabrication technique as well. Generally, the plastic parts will be injection molded but because of the uniformity of thicknesses, they may be vacuum molded or formed by any suitable purpose.

Instead of a breakaway line or portion, fixtures may be sold to separate the top portion from the bottom portion but in the preferred embodiment, a breakaway line is provided for reasons of economy and to avoid the need for selling a fixture or for marking a dividing line to be cut by a scissors or the like which may be done at extra cost and inconvenience.

The removable top portions 88A–88D that seal the nozzle portions 90A–90D at the breakaway lines 92A–92D are generally formed of the same material and, include a relatively easily breakable section to break the portion away cleanly at the breakaway line. In the preferred embodiment, this includes corresponding ones of flat extending wings. These flat extending wings make it easy to twist the removable top portions to encourage a complete even break at the breakaway line. However, any other technique may be utilized and no finger grip at all may be provided and the breakaway portions may still breakaway cleanly at the breakaway line to expose the applicator components.

As shown in FIG. 11, when the top portions 88A–88D are broken away, wicks or brushes or other applicators, such as for example the applicator 24 in FIG. 1, are exposed. Thus the containers 84A–84D are available for use and their liquid or flowable material is available. In the case of a flowable powdered material, a squeeze bottle may be used with a special opening or a roller may be used as the applicator.

The removable top portions 88A–88D are generally T-shaped and each includes a corresponding one of the cylindrical tubular lower stem 96A–96D and cylindrical upper tubular cross portions 100A–100D. Between the cylindrical tubular lower stems 96A–96D are corresponding ones of the dividing edges 92A–92D. The dividing edges 92A–92D are thinned portions between the narrow tubular portions 86A–86D and the lower stems 96A–96D that permit easy separation by twisting or the like.

In FIG. 12, there is shown a top view of the combined flow through applicator and container 10A illustrating the manner in which the low volume containers 82A–82D (FIG. 11) are sealed in a row to the thin base 80 with the corresponding ones of the finger-grip tubular cross portions 100A–100D having the flat extensions extending parallel to each other in a line to permit easy separation by twisting. While the containers 82A–82D are shown arranged in a row on a flat plastic base 80, they may be arranged in any configuration such as circular or square and any number may be fastened to the base 80. The base need not be a thin flat plastic member but may be of any convenient shape including a relatively thick more solid member for support on a surface and need not be connected on a flat, even, horizontal surface of the base but may be for example, mounted to a circular base which can be placed on a hook or the like or a base of any other configuration.

In FIG. 13, there is shown an elevational side view of the combined flow-through applicator and container 10A illustrating the preferred arrangement having the containers 82A–82D aligned on the thin base 80 with the finger grips 100A–100D aligned so that only one is visible. As best shown in FIGS. 11,12 and 13, tubular nozzle openings are formed at 90A–90D when the tops 88A–88D are twisted off to expose the applicators, which in the preferred embodiment are flow through applicators similar to those disclosed in FIGS. 1–10.

During the assembly operation, the base 80 is sealed against the containers after they have been filled so that in most applications, there is no space and a vacuum is formed. However, it is possible in some containers to not completely fill the containers with a flowable material or to fill the container with a liquid and a granular material which will serve as sediment at the bottom and gradually release ingredients into the liquid.

Figure 14:
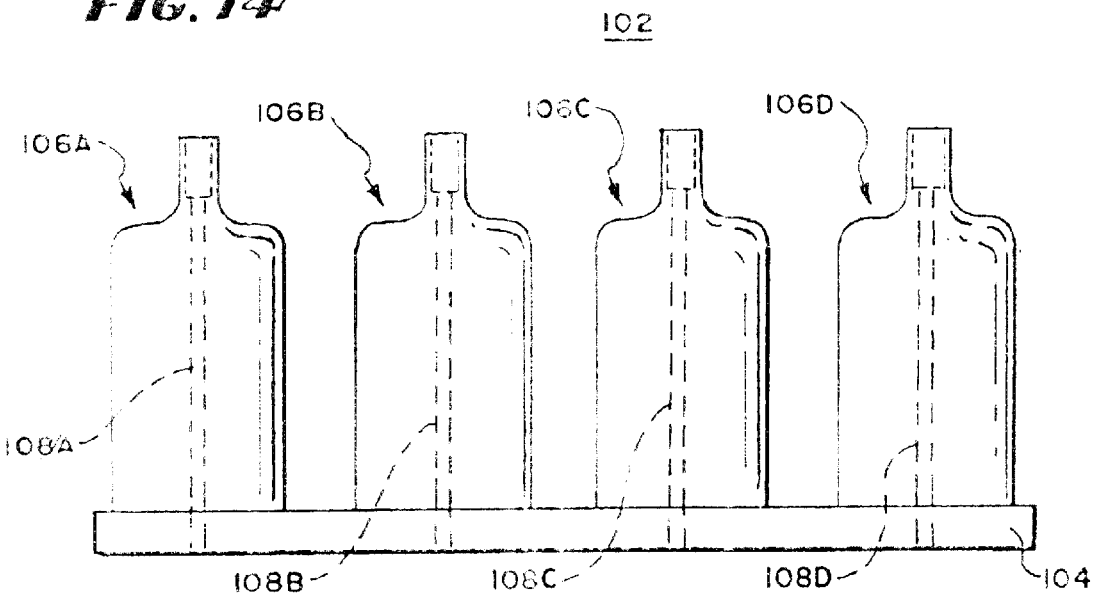
FIG. 14 is an elevational view of a mandril useful in fabricating the embodiment of FIG. 11.
Figure 15:
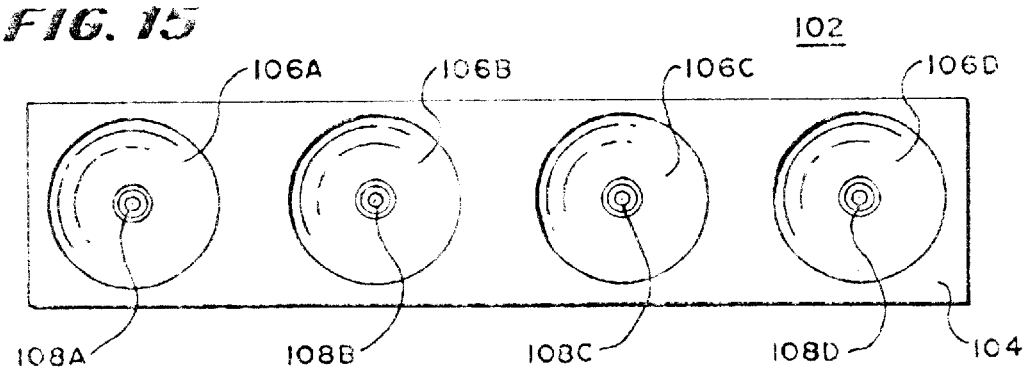
FIG. 15 is a plan view of the mandril of FIG. 14.

In FIGS. 14 and 15, there are shown an elevational view and plan view respectively of a mandril assembly 102 having a mandril base 104 and a plurality of brush-insertion mandrils 106A–106D corresponding to the containers 82A–82D (FIG. 11) to insert flexible applicators, such as tufts or bristles or brushes into the corresponding container. The brush-insertion mandrils 106A–106D are positioned with respect to each other and sized to fit within the corresponding main container portions 84A–84D (FIG. 11) and nozzle portions 90A–90D to a position just below the removable top portions 88A–88D. They are intended to contain the bristles or other members so that the mandril assembly may be inserted accurately within the main containers 84A–84D and nozzle portions 90A–90D to properly position the applicators and then are removed while the applicator is held in place by a applicator-holding rod fixture or vacuum pressure or the like so that it remains. In the embodiment of FIGS. 14 and 15, rod openings for this purpose are shown at 108A–108D. With this technique, all of the bristles may be inserted within the nozzles in an automated operation to render the applicator reasonably inexpensive.

Although the mandril assembly 102 is shown having four mandrils 106A–106D in a straight line configuration, in actuality, the number of mandrils and the arrangement of the mandrils connected to a base conforms to the number of applicator tips or nozzles and their arrangement to perform its function of inserting the applicator tips or nozzles. While it is economical to use a single mandril for a single applicator, multiple mandrils may be used for one combined flow through applicator and container; or a single applicator having more tubular extensions than those of the applicators may be used to insert the applicator components such as the bristles into more than one combined flow through applicator and container 10 in a single application.

Figure 16:
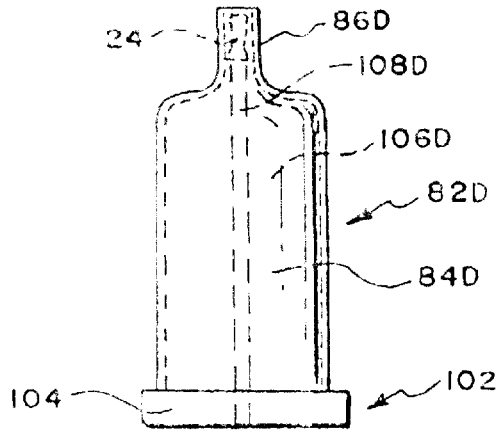
FIG. 16 is a side elevational view illustrating the manner in which a mandril of FIG. 15 cooperates with an open container in the process of assembling a combination of container assembly and flow through applicators of FIG. 11.

In FIG. 16, there is a side view of an open, plastic low-volume container 82D and a mandril assembly 102. The mandril assembly 102 includes the brush insertion mandril 106D, the base 104 and the opening 108D through the center of the brush insertion mandril 106D. The mandril assembly 102 is shown in position to insert a flow-through brush 24 into the container neck 86D of the low volume container 82D prior to the base being attached to an applicator assembly. The brush insertion mandril 106D is fully inserted into the main container portion 84D to insure proper alignment. As best shown in FIG. 15, w which is a bottom view of the mandril assembly 102, the openings 108A–108D extend through the tubes and are positioned to receive the bristle tufts for movement into position in the low-volume container.

Figure 17:
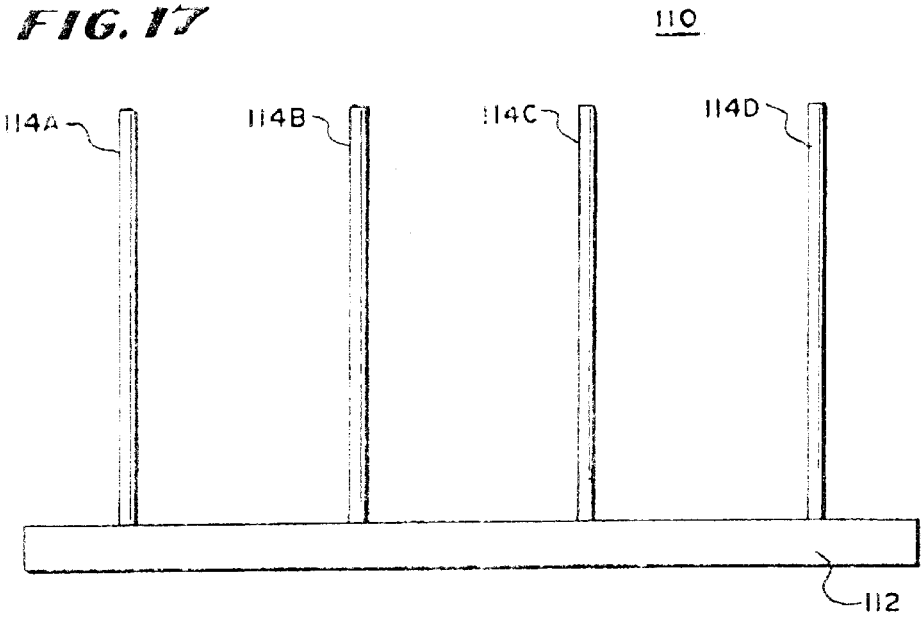
FIG. 17 is a front elevational view of the mandril push tool assembly used in connection with the mandril of FIG. 15.
Figure 18:
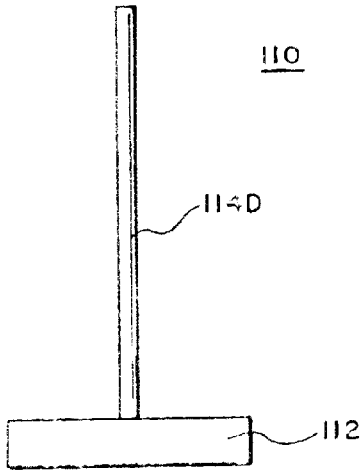
FIG. 18 is a side view of the applicator holding rod fixture of FIG. 17.
Figure 19:
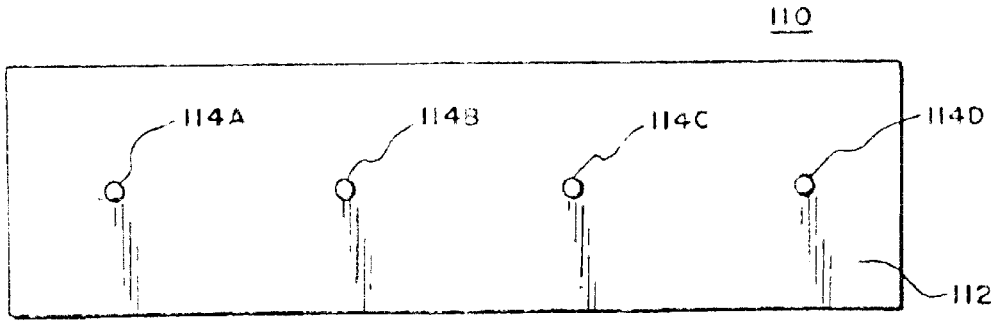
FIG. 19 is a plan view of the applicator holding rod fixture of FIG. 17.

In the front elevational view of FIG. 17, the side elevational view of FIG. 18 and the plan view of FIG. 19, there is shown an applicator-holding rod fixture 110 utilized in connection with the mandril assembly 102 and including a plurality of solid fixtures rods 114A–114D mounted to a base 112 to be in the same relationship as the brush-insertion mandrils 106A–106D of the mandril assembly 102. As shown in the side view of FIG. 18 and the top view of FIG. 19, this fixture is arranged so that with a single operation, it may hold the applicators such as the brushes 24 in a corresponding number of the narrow portions of the low volume containers 82A–82D (FIG. 11) while the mandril assembly 102 is withdrawn from the open containers 82A–82D (see FIG. 16). Consequently, the fixture rods are shaped in size to fit within the inner openings 108A–108D of the mandril assembly 102 having outer diameters slightly smaller than the inner diameters of the openings in the mandril.

Figure 20:
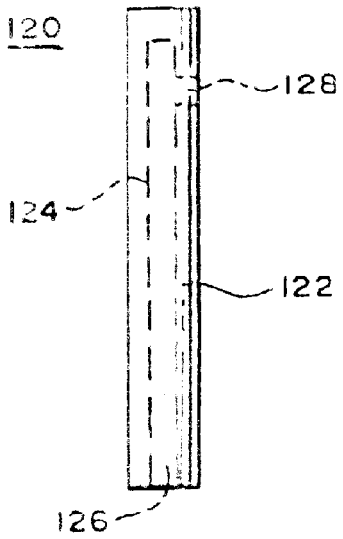
FIG. 20 is an elevational view of another embodiment of an applicator component.

In FIG. 20, there is shown another applicator 120 formed as a narrow tube having tube walls 122, a central longitudinally extending passageway 124, an inlet port 126 and a small outlet port 128 at or near its end. The inlet port 126 permits communication between the applicator passageway 124 and the interior of one of the low-volume containers 82A–82D (FIG. 11) to receive fluids and the outlet port 128 permits communication between the passageway 124 and the surface to which the fluid is to be applied. In the preferred embodiment, the applicator 120 may be a flexible tube with the outlet port 128 slightly offset so that upon flexing against a surface it releases a small amount of liquid or powder onto the surface.

Figure 21:
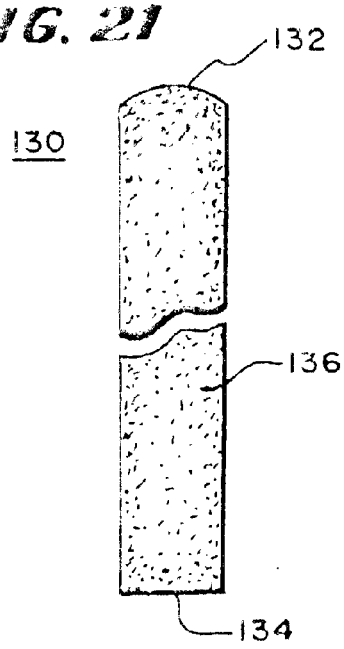
FIG. 21 is a sectional view of still another embodiment of applicator component that may be used instead of the embodiments of FIGS. 2 and 20.

In FIG. 21, there is shown another applicator 130 shaped as a wick having an elongated section 136, a top 132 and a bottom 134, with the wick being intended to extend all the way from the nozzles 90A–90D to the very bottom of the containers 82A–82D (FIG. 11) to cause liquid to flow by capillary action from the wick bottom 134 up to the wick top 132. In this embodiment, when the wick is brushed against a surface, the liquid rubs off of the wick onto the surface.

Figure 22:
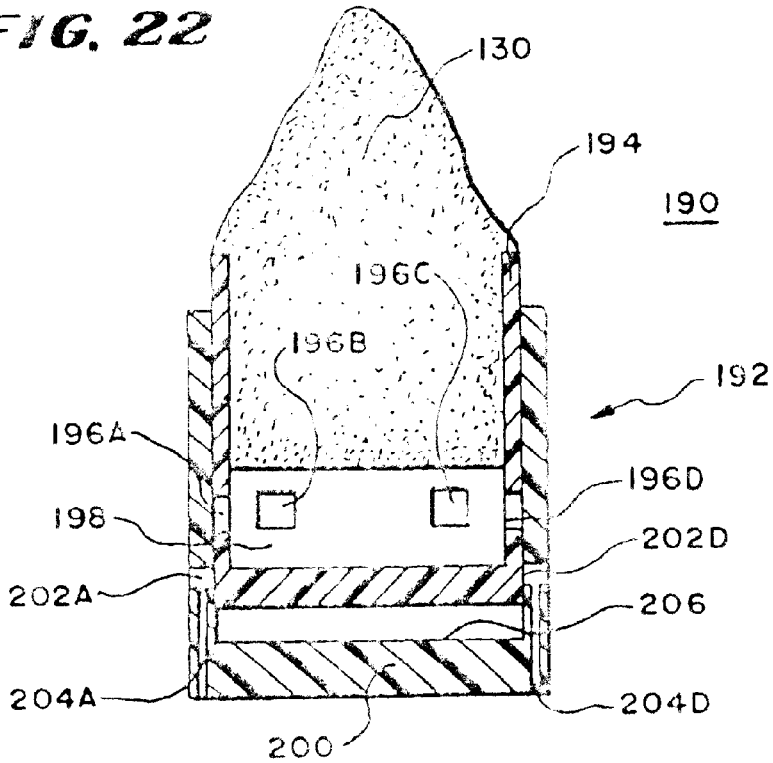
FIG. 22 is a sectional view of still another embodiment of applicator component that may be used instead of the embodiments of FIGS. 2, 20 and 21.

In FIG. 22, there is shown still another embodiment of applicator 190, which is a valve type applicator having a bottom and top means for closing the brush from fluid when not in use. In the embodiment of FIG. 22, the brush is the embodiment of wick 130 shown also in FIG. 21 but mounted in a bottom valve 192 as a first closure means and adapted to be closed at the top by a replaceable closure such as shown at 18 in FIG. 1 that seals the top of the brush or by a twist-off top closure such as that shown at 88A in the embodiment of FIG. 11 or by any other type of closure. With this type of closure, the brush can remain dry when not in use and thereby resist having fluid such as correction fluid or nail polish or the like dry on it.

In the embodiment of FIG. 22, the valve 192 includes an inner cylindrical holder 194 for the wick 130, an outer cylindrical holder 200 for the inner cylindrical holder 194 and a stop surface 206 between the inner cylindrical holder 194 and the outer cylindrical holder 200 spaced between the two to permit movement between the upper cylindrical holder 194 and the lower cylindrical holder 200 by a predetermined distance. The inner cylindrical holder 194 includes a fluid fill space 198 and six spaced apart openings through its wall, openings 196A–196D being shown by example in FIG. 22 and the outer cylindrical holder 200 includes six openings corresponding to the six openings in the inner cylindrical holder, two openings 202A and 202D being shown in FIG. 22. Six channels perpendicular to the six openings in the outer cylindrical holder 200, two channels 204A and 204D being shown in FIG. 22, provide fluid communication between the six openings through the outer cylindrical holder 200 and the fluid within the container holder to which the applicator is attached. While six openings are shown in FIG. 22 by way of example any appropriate number of openings can be used.

In operation, a spring biases the inner cylindrical holder 194 from the outer cylindrical opening, so that when the wick is pushed, the inner cylindrical holder 194 moves downwardly within the outer cylindrical holder 200 so that the openings 196A–196D in the inner cylindrical holder are aligned with the openings 202A–202D in the outer cylindrical holder 200. In this position, fluid flows from the container through the six channels into the six openings in the outer cylindrical holder 200 to fill the fill space 198 in the inner cylindrical holder 194 and thus to bring the fluid in contact with the bottom of the wick for application to the surface being colored or wetted for other reasons. When the wick is not depressed, the six openings in each of the inner and outer cylindrical holders are blocked by the walls of the other of the inner and outer cylindrical holders.

Figure 23:
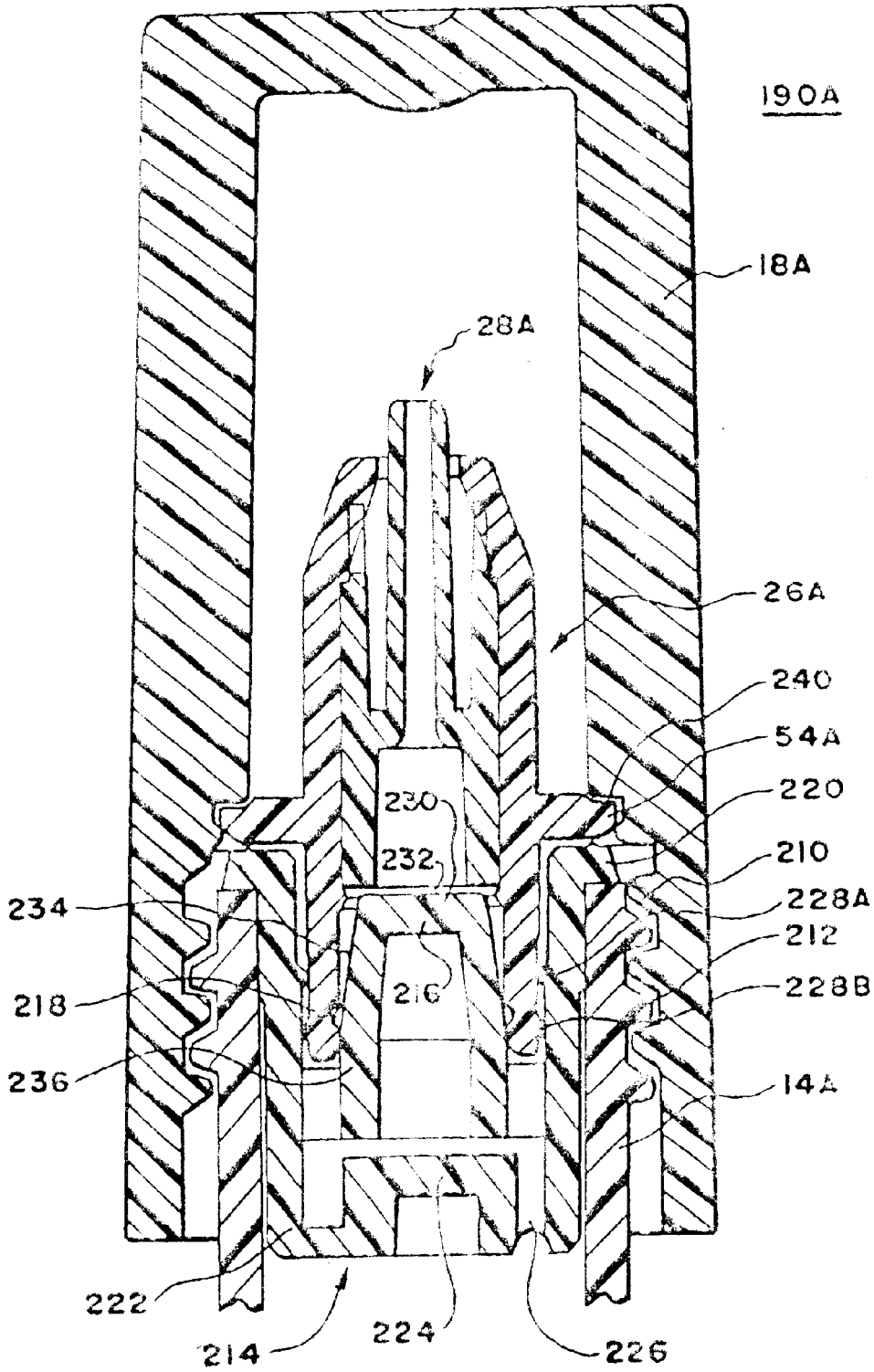
FIG. 23 is a sectional view of a component of still another embodiment of applicator.

In FIG. 23, there is shown still another embodiment of applicator 190A which utilizes a valve to prevent flow of fluid to the nib when the applicator is not in use. In FIG. 23, the valve is cap-actuated so that when the cap is closed, the valve is closed cutting off fluid to the nib and exposure to the atmosphere of the nib. For this purpose, the valve 190A includes features of the container neck 14A, the applicator cap 18A, the outer shell 26A when a flow-through embodiment is utilized, a valve element 216 and a valve frame 214. The cap 18A engages the outer shell 26A when it is threaded or unthreaded on the neck 14A of the container to move the outer shell 26A upwardly or downwardly away or toward the valve element 216 which is held by the valve frame 214 to open or close a flow path between the interior of the container having fluid and the nib of the applicator.

The outer shell 26A is similar to the outer shell 26 of FIG. 4 except that the flange 54A includes an under cut annular portion 240 at its outer end that fits within a complimentarily formed portion of the cap 18A above internal screw threads 210 of the cap 18A. The cap 18A is the same as cap 18 of FIG. 1 except it includes internal threads 210 rather than being a snap-on type of cap. With these internal threads, the flange 54A engages the under cut portion 240 of the cap 18A as the internal threads of the cap 18A are threaded onto the external threads 212 of the container neck 14A. The neck 14A is similar to the neck 14 of the embodiment of FIG. 1 except that it includes external threads 212 that engage the internal threads 210 of the cap 18A. The inner shell 28A is similar to the inner shall 28 of the embodiment of FIG. 3 except that it does not have the flange 42 and instead has a relatively flat bottom surface shaped to engage against the valve element 216 on its surface 230 to close a channel 232 that communicates with the inside of the container.

The valve frame 214 includes an outwardly extending upward flange 220, a cup shaped portion 222 integrally formed with the annular flange 220 at its upper rim and extending downwardly an inverted cup shaped portion 224 centered at the bottom of the cup shaped portion 222. On the inner vertical sides of the cup shaped portion 222 are annular sealing rings 228A and 228B parallel to each other and impinging tightly on the downwardly extending walls of the outer shell 26A to form a liquid seal therewith. On its inner surface is an annular opening 218 that permits fluid to flow from the container upwardly to the channel 232 when the cap is not threaded downwardly enough to close the channel 232. When the cap is threaded downwardly, the valve element 216 contacts the inner shell member 28A and closes it.

The valve element 216 includes the upper stop surface 230 sized to close the central opening within the inner shell 28A to block fluid flow to the nib and downwardly sloping outwardly sides that permit the opening 218 to receive fluid when the outer and inner shells 26A and 28A are lifted upwardly by unthreading the cap but closed against the sloping sides when the cap is tightly threaded down. The bottom of the valve element 216 is positioned to contact the top of the inverted cup shaped member 224 to stop downward movement.

With this arrangement, when the cap 18A is removed, a flow path is formed through an opening 226 in the bottom the valve frame 214 upwardly into the cup shaped member 222 of the frame and around into the opening 218 and from there to the channel 232 then to the nib of the inner shell 28A for spreading. However, when the cap 18A is threaded down tightly, the channel 232 is blocked and the opening 218 is blocked by the surface 234 of the valve element 216 abutting against the bottom walls of the inner shell 28A.

Figure 24:
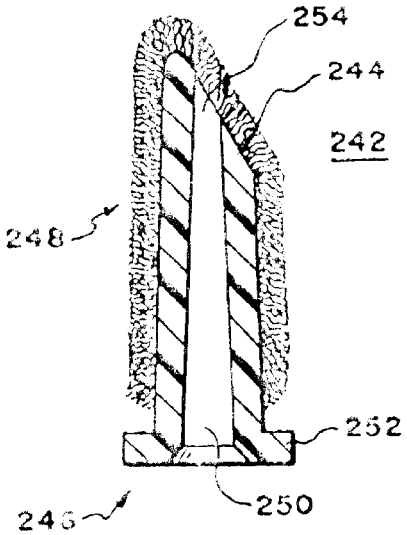
FIG. 24 is a sectional view of a component of still another embodiment of applicator.

In FIG. 24, there is shown a sectional view of another applicator 242 having an inner plastic base 246 and an outer coat of nylon flocking 248 and an inner fluid passageway 250. The passageway 250 is tapered from the bottom to the top being approximately 65 thousandths of an inch at the bottom and conically extending to a tip which is an opening of 27 thousandths of an inch. The inner plastic base 246 includes a flange 252 and an upwardly extending frustrum of a cone 244 extending from the flange 252 and forming the central conical channel 250. The cone is approximately 500 thousandths of an inch in length but maybe in a range of 250 thousandths to one inch in length. At the upper most portion, an angular frustrum of a cone is formed, which in the preferred embodiment is 60 degrees from the horizontal as shown at 244 but may be in a range of angles between 30 and 80 degrees from the horizontal. It is generally elliptical being a section of a cylinder having a diameter of approximately 200 thousandths of an inch but may be in a range of between 1/10th and 5/10ths of an inch. The nylon flocking 248 covers the entire outer surface of the base 246 except for an opening at 254.

Figure 25:
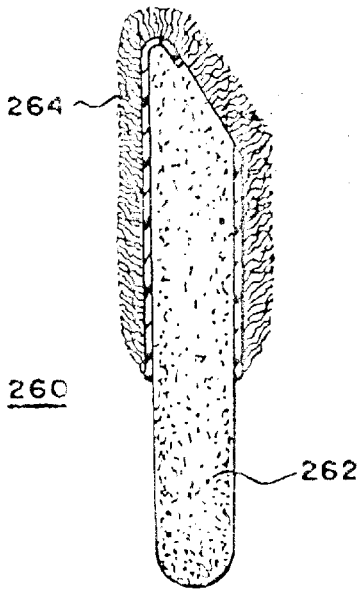
FIG. 25 is a sectional view of a component of still another embodiment of applicator.

In FIG. 25, there is shown another embodiment of applicator 260 similar to the embodiment of FIG. 24 only instead of a base cone 246, a solid wick 262 is provided with a similar cut on the top end and covered with flocking 264 so that fluid is moved through the wick 262 into the flocking 264 for application to a surface by capillary action.

Figure 26:
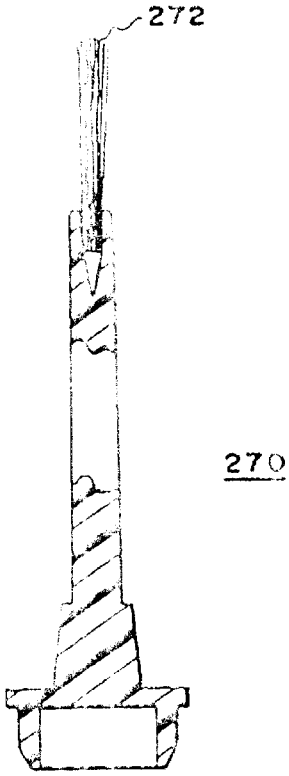
FIG. 26 is a sectional view of a component of still another embodiment of applicator.

In FIG. 26, there is shown a sectional view of another embodiment of applicator 270. This embodiment is unique only to the extent that the bristles include a dome shaped top 272 cut by a special method. The dome shaped top, when pressed against a surface which fluid is to be applied forms a flat section and results in more even spreading of the fluid.

Figure 27:
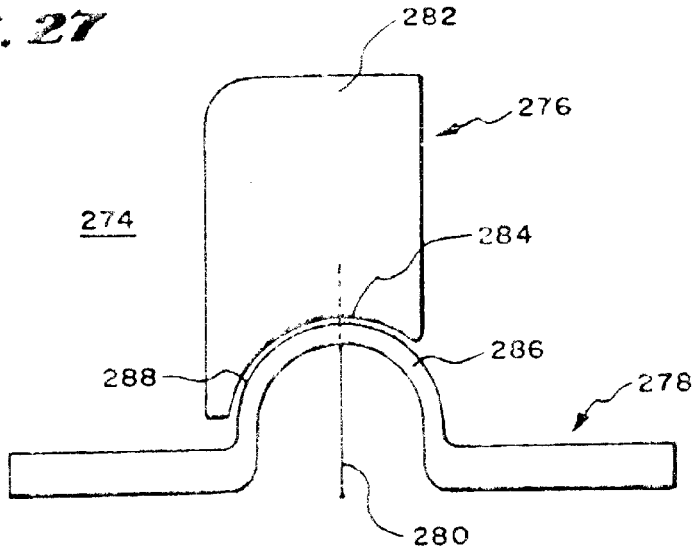
FIG. 27 is a simplified, fragmentary plan view of a trimmer useful in making the embodiment of tip shown in FIG. 26.

In FIG. 27, there is shown a simplified schematic view of a trimmer 274 used in forming the dome shaped top 272 (FIG. 26) having a moveable blade 276, a stationery blade 278 arranged to trim a plurality of bristles such as the one shown at 280 as an example. The movable blade 276 has a generally flat portion 282 with an arcuate cutting edge 284 and the stationery blade 278 has an arcuate cutting surface 286 with a cutting edge at 288. With this arrangement, bristles such as 280 are brought into position to be cut by the two cutting edges 284 and 288 in a scissor like operation a few at a time. This is accomplished by rotating the tip so that the bristles are brought into position a few at a time to be cut and form the dome as the bristles are rotated.

Figure 28:
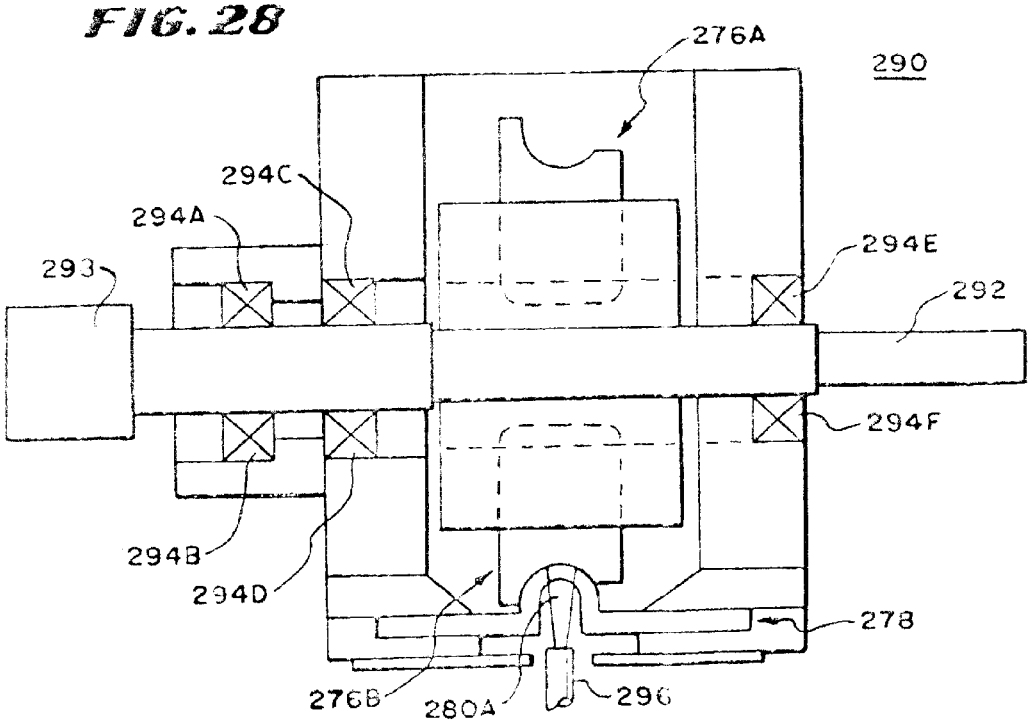
FIG. 28 is a simplified plan view of the trimmer of FIG. 27 as used in a production run.

In FIG. 28, there is shown a simplified plan view of an embodiment 290 of a multiple blade trimmer having a rotatable shaft 292, moveable blades 276A and 276B and a stationery trimmer blade 278. The moveable blades 276A and 276B are mounted for rotation with the shaft 292 which is rotatably driven within bearings 294A–294F by a motor means 298. While the movable blades 276A and 276B are rotating, their cutting edges come into contact with the cutting edge of the stationery blade 278 to trim a few fibers at a time of the applicator tip 280A as the applicator tip is rotated by a motor means 296, preferably in synchronism with the motor means 298 for the shaft 292. With this arrangement, a dome shaped top is economically cut in the tip of the applicator as shown in FIG. 26.

While several different forms of applicators are shown and described in this application, there are innumerable types of applicators. The wide literature including the patent literature includes descriptions well known to persons of ordinary skill in the art and there is catalog information freely available to the public illustrating the equivalents of different embodiments for use in the invention.

Figure 29:
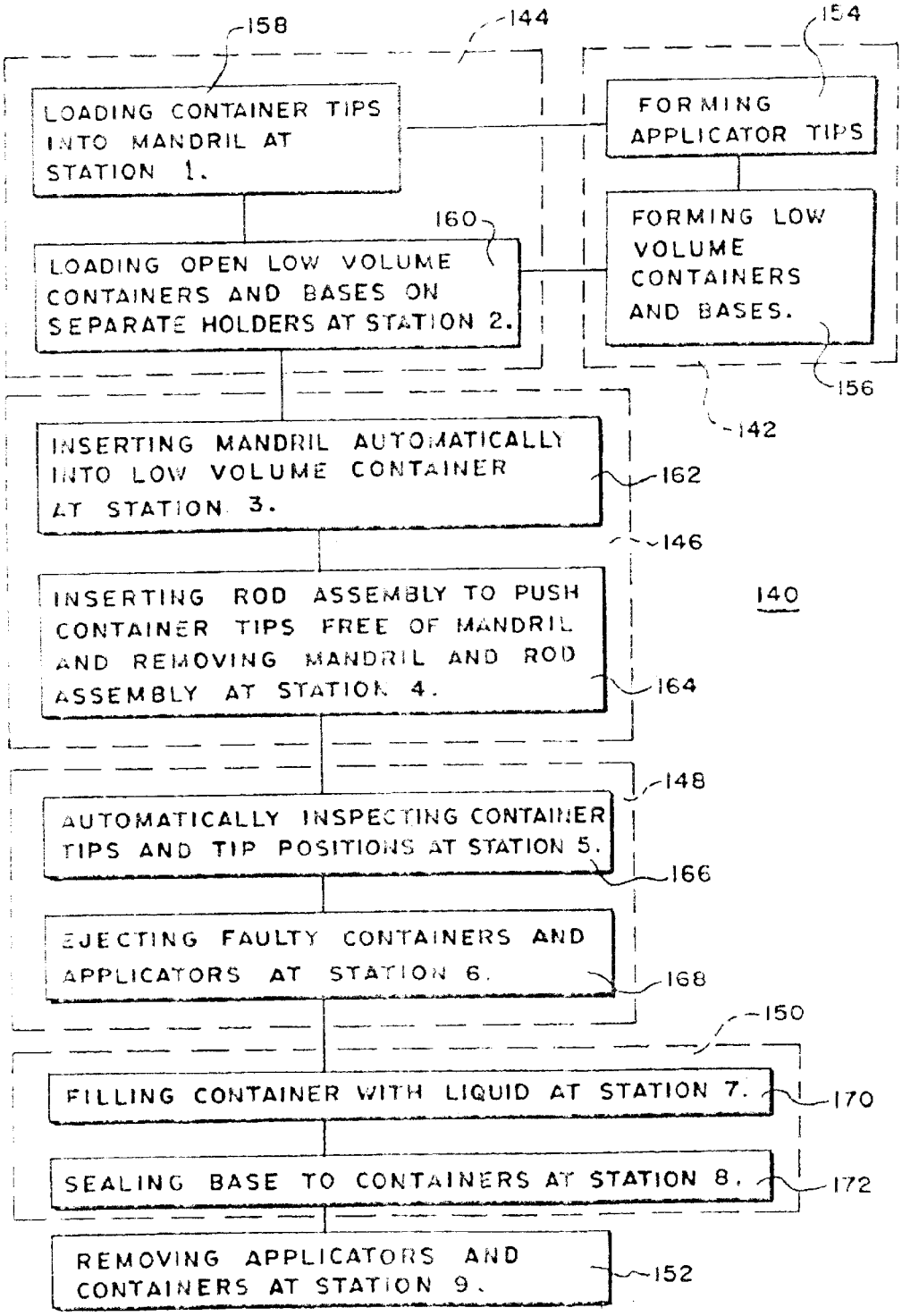
FIG. 29 is a block diagram illustrating the steps in assembling the embodiment of FIG. 11.

In FIG. 29, there is shown a block diagram of the steps utilized in one embodiment 140 of a process of assembling the combined flow through applicator and container 10A (FIGS. 11–13) including the step 142 of forming or obtaining the applicator tips, plastic containers and bases, the step 144 of loading the components onto a multistation assembly apparatus 180 (FIG. 30), the step 146 of assembling the tips or nozzles onto the low-volume containers 82A–82D, the step 148 of inspecting the containers and tips and rejecting faulty combinations, the step 150 of filling and sealing the containers and the step 152 of removing the containers for eventual packaging and sale. In the preferred embodiment, these steps are performed in the order described above to form the combined low flow applicator and containers efficiently in an automated process.

The step 142 includes the step 154 of forming the applicator tips in the manner described in connection with FIG. 9 and the step 156 of forming the plastic containers 82 and bases 80 for the applicator assembly. The plastic parts 82 and 80 are injection molded as indicated at step 156 in a manner known in the art. Once these parts have been fabricated to meet the descriptions above, they are loaded onto the multi-station assembly apparatus (FIG. 30) for assembling together as indicated by step 44. The container tips are loaded into the mandril in the first station as indicated by step 158 and the containers and bases are loaded on different holders at a second station as indicated by step 160. After these components have been loaded, the mandril that now includes the container tips is automatically lowered onto the inverted open low volume containers at a third station as indicated by step 162 and the rod assembly is pushed downwardly to insert the applicator tips free from the mandril and into the container narrowed portion so that when the container tips are twisted off, the nozzles are in place as indicated by step 164.

In station 5 (FIG. 30), the step of automatically inspecting the container tips and tip positions as indicated by step 166 is performed. This can be done optically through the plastic to sense the tips. During the inspection process, if the tips are not properly placed, they are injected together with the container as shown at step 168. Once the tips are in place, with the housing still inverted, it is filled with liquid to leave no air voids as shown in step 170 and the base is sealed onto the container at station 8 as shown by step 172. The applicators can then be removed.

Figure 30:
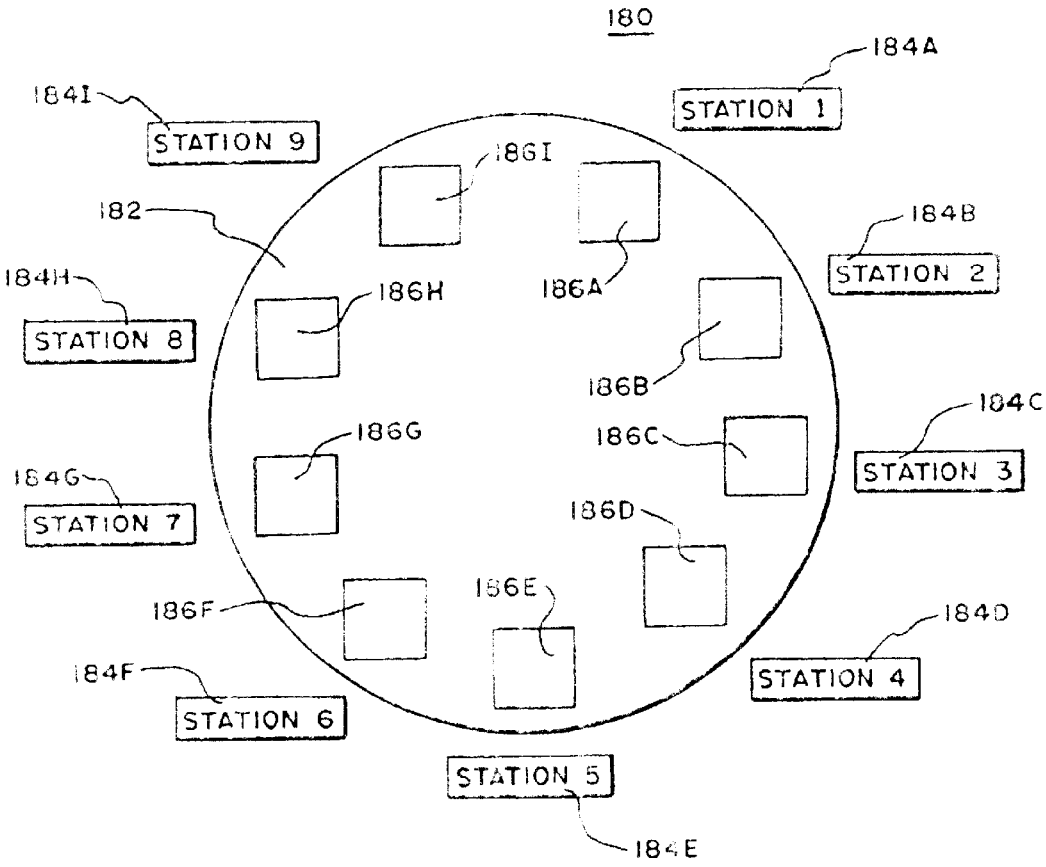
FIG. 30 is a diagrammatic view of a layout for assembling the embodiment of FIG. 11.

In FIG. 30, there is shown the assembly 180 including a turntable 182, nine work stations 184A–184I and nine work holders 186A–186I. The turntable 182 is arranged to include the nine identical work holders 186A–186I which rotate with the table from work station to work station. The work holders 186A–186I each include a fixture for holding the one set of container assemblies such as the assemblies 82A–82D (FIG. 11) aligned and spaced from each other equally to be capable of forming a complete assembly when a base such as 80 (FIG. 11) seals the containers after the nozzle portions such as 90A–90D (FIG. 11) have been inserted but with the removable top portions 88A–88D still in place as molded and extending from the weakened areas 92A–92D (FIG. 11) formed by the injection molding. A mandril assembly 102 (FIGS. 14 and 15) is also mounted above the work holders 186A–186I and aligned with the work holders containing corresponding brush insertion mandrils 106A–106D (FIGS. 14 and 15) positioned so they can be moved downwardly into the individual containers.

To prepare the finished combination tips and containers, the work holders 186A–186I move from station to station 184A–184I with each station supplying a component or providing an arrangement to permit working on the unfinished work piece or ejecting the work piece either as scrap or as a finished product. At work station 1, shown at 184A, a chute from a bin containing tips is fed into the inverted mandril mounted at each of the work holders above the work holder for the plastic containers. In the alternative, an operator can physically insert a tip into each of the mandrils of a mandril assembly 102.

At work station 2, shown at 184B, a first chute loads the appropriate number of open low-volume containers, there being four such containers 84A–84D (FIG. 11) in the example of this specification, into a corresponding set of four holders spaced with equal spacing as that between the mandrils of the mandril assembly 102 and feeds a single base into the base holder in position to be placed over the containers to form a finished applicator. At work station 3, shown at 184C, the mandril assembly 102 is moved downwardly so that the mandril moves into each of the low volume containers forming the applicator and container combination 10A, carrying the tips into the narrowed portions of the containers below the thinned portion. Again this operation can be done manually or automatically as known in the art.

At work station 4, shown at 184D, the inverted rod assemblies 110 (FIGS. 17–19) are moved downwardly so that individual push rods 114A–114D (FIGS. 17–19) in the example of this specification, move the tips into position in the narrowed portion of the containers. This also can be done manually as well as automatically. The push rods 114A–114D have sufficient force to move the tips into the plastic portions where they are held firmly by friction and the elastic force resisting the oversized tips in the narrowed portion.

At work station 5, shown at 184E, an optical arrangement inspects the combined applicator and containers for proper positioning and structure. This can be done by an inspector who visually inspects them or by a beam of light that tests the position of the bristles. At work station 6, shown at 184F, faulty containers are ejected. This may be done by a delayed signal from work station 5 indicating that the combined container and tip 10A is faulty or an individual may remove it at this station. Work station 7, shown at 184G, includes the liquid to be applied and the appropriate valve for filling the containers with the liquid so there are no air spaces. Again this may be done manually by operating a valve for this purpose.

At work station 8, shown at 184H, the base that is being carried by the turntable 182 is moved over the inverted, fluid-filled containers and sealed in place by adhesive or heat sealing. This closes the containers in an airtight manner to form a vacuum. An operator may place it in place and move the sealing mechanism or it may be done automatically. At work station 9, shown at 184I, the completed combination applicators and containers 10A are removed for being packaged and shipped.

From the above description, it can be understood that the flow-through applicator of this invention is simply and easily assembled and is economically made.

Although a preferred embodiment of the invention has been described with some particularlity, many modifications and variations in the preferred embodiment are possible within the light of the above teachings. Therefore, it is to be understood that, within the scope of the claims, the invention may be practiced other than as specifically described.

What is claimed is:

1. An applicator comprising:

plurality of containers;

a plurality of nibs each adapted to receive a fluid from a corresponding one of the plurality of containers and impart the fluid to a surface upon contact with a nib, wherein at least some of said nibs are brush type applicator nibs having a plurality of bristles with clamp means holding the bristles in communication with the interior of a brush type applicator container and containing slots extending longitudinally therein;

a connecting member;

said plurality of containers being connected together by said connecting member, whereby an individual container and its corresponding nib may be used to apply fluid to said surface; and a plurality of removable top portions each of which removably covers a corresponding nib when sealed to its corresponding container until the seal is broken, whereby the nib is enclosed by its corresponding container and removable top portion until the container is to be used to apply the fluid to a surface.

2. An applicator in accordance with claim 1 in which at least one of said plurality of nibs is a brush nib with dense bristles of thin diameter but sufficient stiffness to be self standing resulting in an ability to apply fluid more evenly than conventional thicker bristles with lower density.

3. An applicator in accordance with claim 2 in which said bristles are Nylon bristles having diameters in the range of between 2 to 5 mils.

4. An applicator comprising:

a plurality of containers;

a plurality of nibs each adapted to receive a fluid from a corresponding one of the plurality of containers and impart the fluid to a surface upon contact with a nib, wherein at least one of said plurality of nibs comprises a brush and brush holder; said brush being formed to have a central opening and being inserted into said brush holder having an opening, with the opening of the brush holder extending part-way into the central opening of the brush, one end of the brush being within an annular groove circumscribing the opening in the brush holder;

a connecting member;

said plurality of containers being connected together by said connecting member, whereby an individual container and its corresponding nib may be used to apply fluid to said surface; and a plurality of removable top portions each of which removably covers a corresponding nib when sealed to its corresponding container until the seal is broken, whereby the nib is enclosed by its corresponding container and removable top portion until the container is to be used to apply the fluid to a surface.

5. An applicator in accordance with claim 4 in which the brush is held in place by a plurality of clamp means surrounding the annular groove, which is formed in an inner shell of the brush holder, said clamp means being adapted to hold the brush in place upon final assembly of the brush holder.

6. An applicator comprising:

a plurality of containers;

a plurality of nibs each adapted to receive a fluid from a corresponding one of the plurality of containers and impart the fluid to a surface upon contact with a nib, wherein at least one of said plurality of nibs is a brush type applicator nib having a plurality of bristles and including at its outlet an outer shell and an inner shell holding the bristles and forming a bristle-lined tubular-cylindrical outlet, the interior of the inner shell communicating with the interior of a container at one end and with its outlet at the other end through a circle of bristles;

a connecting member;

said plurality of containers being connected together by said connecting member, whereby an individual container and its corresponding nib may be used to apply fluid to said surface; and a plurality of removable top portions each of which removably covers a corresponding nib when sealed to its corresponding container until the seal is broken, whereby the nib is enclosed by its corresponding container and removable top portion until the container is to be used to apply the fluid to a surface.

7. A method of using the applicator of claim 1 comprising the steps of releasing an ingredient from the applicator, said step of releasing the ingredient from the applicator includes the step of exposing at least one of said plurality of nibs.

8. An applicator comprising:

an applicator nib;

an applicator nib holder adapted to connect to a fluid container and provide fluid communication between the contents of the container and the nib;

said nib including a brush;

said brush being formed to have a central opening and being inserted into a brush holder having an opening, with the opening of the brush holder extending partway into the central opening of the brush, one end of the brush being within an annular groove circumscribing the opening in the brush holder;

wherein the nib includes at its outlet an outer shell and an inner shell holding the brush and forming a bristle-lined tubular-cylindrical outlet, wherein the interior of the inner shell communicates with the interior of the container at one end and with its outlet at the other end through a circle of bristles.

9. An applicator comprising:

a plurality of containers;

a plurality of nibs each adapted to receive a fluid from a corresponding one of the plurality of containers and impart the fluid to a surface upon contact with a nib;

a connecting member, wherein the connecting member is a thin, flat plastic member and each of the plurality of containers includes a corresponding flat bottom sealed to said thin, flat plastic members;

said plurality of containers being connected together by said connecting member, whereby an individual container and its corresponding nib may be used to apply fluid to said surface; and a plurality of removable top portions each of which removably covers a corresponding nib when sealed to its corresponding container until the seal is broken, whereby the nib is enclosed by its corresponding container and removable top portion until the container is to be used to apply the fluid to a surface.

10. An applicator in accordance with claim 9 in which each of said containers is filled with a different fluid.

11. An applicator in accordance with claim 10 in which each of said different fluids is fingernail polish of a different color.

* * * * *